US006189516B1

(12) United States Patent
Hei Ma

(10) Patent No.: US 6,189,516 B1
(45) Date of Patent: Feb. 20, 2001

(54) FUEL VAPOR EXTRACTION SYSTEM

(75) Inventor: Thomas Tsoi Hei Ma, Essex (GB)

(73) Assignee: Ford Global Technologies, Inc., Dearborn, MI (US)

( * ) Notice: Under 35 U.S.C. 154(b), the term of this patent shall be extended for 0 days.

(21) Appl. No.: 09/463,085

(22) PCT Filed: Jul. 31, 1998

(86) PCT No.: PCT/GB98/02292

§ 371 Date: Jan. 19, 2000

§ 102(e) Date: Jan. 19, 2000

(87) PCT Pub. No.: WO99/06689

PCT Pub. Date: Feb. 11, 1999

(30) Foreign Application Priority Data

Aug. 1, 1997 (GB) ..... 9716156

(51) Int. Cl.[7] ..... F02M 31/18; F02M 33/06

(52) U.S. Cl. ..... 123/524; 123/514; 123/516; 123/557

(58) Field of Search ..... 123/524, 525, 123/526, 527, 545, 546, 547, 557, 432, 1 A, 3, 506, 514, 516, 518, 307, 519, 520, 521, 522, 523

(56) References Cited

U.S. PATENT DOCUMENTS 4,432,329 * 2/1984 Redele ..... 123/557
5,359,978 * 11/1994 Kidokoro et al. ..... 123/520
5,687,697 * 11/1997 Ishikawa ..... 123/520
5,711,282 * 1/1998 Lang et al. ..... 123/549
6,014,958 * 1/2000 Miwa et al. ..... 123/520
6,129,835 * 10/2000 Lesieur et al. ..... 208/208 R

* cited by examiner

*Primary Examiner*—Willis R. Wolfe
*Assistant Examiner*—Hai Huynh
(74) *Attorney, Agent, or Firm*—Jerome R. Drouillard

(57) ABSTRACT

A fuel vapour extraction system is described for an internal combustion engine (10) that is supplied with a volatile liquid fuel from a fuel storage tank (20). The engine (10) has an air intake system (12, 14, 16) and a liquid fuel injection system for dispensing fuel to mix with air to be burnt in the engine. The fuel vapour extraction system includes a volatizing chamber (30) connected to the fuel storage tank (20) by a valve (26) serving to maintain a constant liquid level of fuel in the chamber (30). A pipe (42) connected to one or more vacuum sources leads into the vapour space above the liquid level in the chamber (30) and maintains a reduced pressure in the volatizing chamber. The fuel injection system includes a fuel circulation pump (32) for drawing liquid fuel from the volatizing chamber (30) and supplying the fuel under pressure to a fuel rail (34), fuel injectors (18) for dispensing metered quantities of fuel from the fuel rail (34) to the engine cylinders, and a relief valve (36) for maintaining a constant fuel pressure in the fuel rail (34) and returning unused fuel from the fuel rail (34) to the reduced pressure vapour space in the volatizing chamber (30) by way of a fuel return pipe (38). An evaporator (40) is provided in the vapour space of the volatizing chamber (30) to act as a means for increasing the surface area to volume ratio of the return fuel. The return fuel comes into intimate thermal contact with the evaporator (40) and spreads over a large area of the evaporator (40) exposed to the reduced pressure in the volatizing chamber (30).

10 Claims, 1 Drawing Sheet

FUEL VAPOR EXTRACTION SYSTEM

FIELD OF THE INVENTION

The present invention relates to a fuel vapour extraction system for an internal combustion engine supplied with a volatile liquid fuel from a fuel storage tank, the engine having an air intake system and a liquid fuel injection system for dispensing fuel to mix with air to be burnt in the engine.

BACKGROUND OF THE INVENTION

There are known, in particular from marine applications, fuel vapour extraction systems for an internal combustion engine that is supplied with a volatile liquid fuel from a fuel storage tank and that has an air intake system and a liquid fuel injection system for dispensing fuel to mix with air to be burnt in the engine. The fuel vapour extraction system includes a volatising chamber connected to the fuel storage tank by a valve serving to maintain a constant liquid level of fuel in the chamber and a vapour space above the liquid level in the chamber, and means for drawing vapour from the vapour space in order to maintain a reduced pressure in the volatising chamber. The fuel injection system includes a fuel circulation pump for drawing liquid fuel from the volatising chamber and supplying the fuel under pressure to a fuel rail, fuel injectors for dispensing metered quantities of fuel from the fuel rail to the engine cylinders, a relief valve for maintaining a constant fuel pressure in the fuel rail and a fuel return pipe for returning unused fuel from the fuel rail to the volatising chamber. Examples of such systems are to be found in U.S. Pat. Nos. 5,647,331, 5,115,784 and 5,579,740 and in WO89/06312.

Such systems are employed in marine applications because safety regulations relating to marine vessels in some countries forbid the return of fuel from the injection system to the main fuel storage tank. Instead the fuel is returned to a separate chamber and steps are taken to extract vapour from the latter chamber to avoid vapour lock in the fuel. These systems do not intentionally fraction the fuel to enable the engine management system to make the best use of the different fractions.

U.S. Pat. No. 5,373,825 discloses a fuel vapour extraction system intended for an engine burning a heavy oil that comprises a volatising chamber separate from the fuel tank for intentionally volatising the lighter fraction of the oil. Within the volatising chamber, the oil is heated by a heating element and the lighter fraction of the oil is driven out by the applied heat at substantially ambient air pressure, ambient air being admitted into the chamber to mix with the gasified fuel-and transport it to the air supply of the engine. The remaining liquid fraction that is not gasified is also drawn from the volatising chamber by a fuel injection system and injected into the combustion chamber of the engine. Only a small quantity of surplus oil, that is not injected into the engine, is recycled to the volatising chamber.

This vapour extraction system has the advantage of achieving a continuous supply of fuel vapour, the availability of which can be used to advantage by a suitably designed engine operating with vaporised fuel. However, to achieve a continuous vapour supply, heating energy must be applied continuously to heat the oil which is a drain on the fuel consumption of the engine. The heating element raises the temperature of the oil to a point where the lighter fraction begins to boil and further heating then provides the latent of heat of vaporisation for maintaining a steady gasifying rate.

If the invention is applied to gasoline fuel instead of a heavy oil, the remaining liquid fraction that is drawn from the volatising chamber will be too hot and will need to be cooled before it is delivered to the fuel injection system in order to avoid vapour lock in the fuel injection system. If the bulk of the fuel is recirculated, as occurs in gasoline engines under idle and low load conditions, the system becomes very wasteful of energy as the same fuel is repeatedly heated and then cooled, which is reflected in high fuel consumption.

There are several other disadvantages associated with the application of external heat to the fuel in the volatising chamber. For example, during cold start, there will not be available an adequate supply of vapour until the temperature of the fuel has been raised sufficiently. Furthermore, because of the slow response of the heating element, it will not be possible to increase the vapour flow rapidly when there is sudden increase in the demand for vapour. Also, because of the limited rate at which the heated fuel can be cooled, it will not then be possible to cool the increased flow of the hot liquid fuel sufficiently rapidly before it enters the fuel injection system, thereby risking vapour lock.

OBJECT OF THE INVENTION

The present invention therefore seeks to provide a continuous supply of fuel vapour that does not rely on the use of an externally powered heating element to heat the fuel to promote its vaporisation.

SUMMARY OF THE INVENTION

According to the present invention, there is provided a fuel vapour extraction system for an internal combustion engine supplied with a volatile liquid fuel from a fuel storage tank, the engine having an air intake system and a liquid fuel injection system for dispensing fuel to mix with air to be burnt in the engine, the fuel vapour extraction system including a volatising chamber connected to the fuel storage tank by a valve serving to maintain a constant liquid level of fuel in the chamber and a vapour space above the liquid level in the chamber, and means for drawing vapour from the vapour space in order to maintain a reduced pressure in the volatising chamber, the fuel injection system including a fuel circulation pump for drawing liquid fuel from the volatising chamber and supplying the fuel under pressure to a fuel rail, fuel injectors for dispensing metered quantities of fuel from the fuel rail to the engine cylinders, a relief valve for maintaining a constant fuel pressure in the fuel rail and a fuel return pipe for returning unused fuel from the fuel rail to the volatising chamber, characterised by means within the vapour space of the volatising chamber for promoting evaporation of the return fuel by significantly increasing the surface area to volume ratio of the return fuel.

The means for promoting evaporation can be means for atomising the fuel into fine droplets or the fuel may be allowed to fall on an evaporator of large surface area.

In use, fuel evaporates off the evaporator or from the droplets by virtue of the reduced pressure biasing the vapour equilibrium in the volatising chamber, and in the process cools the remaining fuel by drawing heat from it to supply the latent heat of vaporisation. This heat is replenished by transfer of heat contained in the fuel returning to the volatising chamber after circulating through the fuel rail and picking up waste heat from the fuel pump, the engine block and the engine compartment.

Although the transfer of heat from the fuel is relatively small for each pass of the fuel through the volatising chamber, sufficient heat can still be extracted to support the vapour equilibrium and maintain a steady evaporation rate if the fuel is circulated at a high flow rate.

The volatile liquid fuel in the fuel storage tank may be a single component fuel like methanol, or it may be a blend of hydrocarbon fuels like gasoline having a range of boiling points.

The means for drawing the fuel vapour and maintaining a reduced pressure in the vapour space of the volatising chamber may be a venturi section in the air intake passage leading to the intake system of the engine, or it may be a low pressure region in the intake system of the engine downstream of the engine main throttle. Alternatively these means may be a vacuum pump driven directly or indirectly by the engine.

In contrast with the prior art discussed earlier, the present invention relies on controlling the vapour equilibrium in the volatising chamber to regulate the availability of the vapour. This process is reversible and the exchange of vapour with the liquid may be in either direction depending on the applied pressure in the volatising chamber, vapour coming out of the liquid if the pressure in the vapour space is further reduced while vapour going back into the liquid if the pressure is increased. This is accompanied by cooling or heating of the fuel respectively which in turn would reduce the rate of exchange of vapour. In order to prevent this and achieve a steady rate of vapour exchange, a stable temperature in the evaporator must be maintained and this is achieved by passing the recirculated fuel over the evaporator to replenish the heat loss or heat gain by exchanging heat between the fuel and the evaporator.

In the present invention, although a reduced pressure is only applied to the volatising chamber for the purpose of extracting fuel vapour from the volatising chamber, the above vapour exchange in either direction can still occur under dynamic conditions when the reduced pressure is varied from a lesser vacuum to a higher vacuum or vice-versa. The time constant for the equilibrium to stabilise would depend on the volume capacity of the vapour in the volatising chamber. This time constant may be extended by increasing the vapour storage within the volatising chamber.

It is preferred for the evaporator to be a matrix of fine capillary tubes or porous granules. To extend the equilibrium time constant, the material of the matrix may be chemically active to act as a vapour store, for example, it may be formed of activated carbon.

In the invention, at no time is the liquid fuel anywhere in the fuel system hotter than the normal temperature at which the fuel injection system is designed to operate thus eliminating any risk of vapour lock, yet the amount of heat required to sustain a predetermined evaporation rate will be adequate provided that sufficient flow circulation in the fuel injection system is maintained. Under low engine load conditions, the amount of vapour drawn from the vapour space and the amount of the liquid fuel injected into the engine are both small with the result that the circulation flow will be large and will easily meet the requirement to support the desired evaporation rate. Under high load conditions, the engine fuel demand is high and the resulting circulation flow will be small. As a result, the rate at which vapour is exchanged in equilibrium in the volatising chamber will be reduced but that does not present a problem as the engine at this time is better operated with little or no vapour in order to maximise its output power.

Because of the large exposed area of the evaporator or the fine atomisation of the return fuel, a substantial flow of fuel vapour may be extracted from the volatile liquid purely by reduced pressure biasing the vapour equilibrium, the vapour flow being a function of the available exposed area and the differential vapour pressure, this being the difference between the reduced pressure in the vapour space and the saturation vapour pressure of the liquid at the temperature of the evaporator.

By providing a large surface area from which fuel can evaporate and applying a predetermined reduced pressure below the saturation vapour pressure, the amount of vapour fuel fraction extracted from the evaporator may be varied from a few percent to 100% by weight of the fuel as long as a stable differential vapour pressure can be maintained. On the other hand, the differential vapour pressure may change during the evaporation process because of cooling of the evaporator causing the saturation vapour pressure to decrease and reducing the evaporation rate as a consequence.

In the present invention, the temperature of the remaining fuel can be kept substantially constant by the heat transported to the volatising chamber by the flow of fuel circulating in the fuel injection system, counteracting the cooling effect and maintaining a steady evaporation rate according to the applied reduced pressure.

The instantaneous flow rate of vapour fraction leaving the volatising chamber may be regulated by a metering valve provided that the density of the vapour upstream of the valve and the pressure drop across the valve are known, and these may be determined using measurements from a pressure sensor and a temperature sensor in the volatising chamber. For any desired ratio of the fuel fractions to be supplied to the engine in vapour and liquid forms, the total fuel quantity may be divided accordingly and each fraction metered separately to the engine by way of the vapour metering valve and the liquid fuel injectors, respectively.

During idle and part load operations, a substantial proportion of fuel vapour may be introduced into the intake manifold of the engine, while the appropriate amount of the remaining liquid fuel to make up the original composition of the volatile fuel may be dispensed separately into the intake ports or directly into the engine cylinders by way of the fuel injection system.

During high load operation, the fuel vapour may be shut off and 100% of the volatile fuel is dispensed by the liquid fuel injection system.

A range of ratios of the vapour and liquid flow fractions may be drawn from the volatising chamber while the operating point in the chamber moves to find its own equilibrium. For example, if the liquid fraction is not transported out of the chamber by not dispensing any fuel through the fuel injection system, the equilibrium will move until the vapour would transport out 100% of the fuel. On the other hand, if the vapour fraction is not transported out of the chamber by shutting off the reduced pressure source, the vapour pressure in the chamber will rise until it equals the saturation vapour pressure and the equilibrium will move in the opposite direction until the liquid would transport out 100% of the fuel. In other words, the system will respond according to demand provided that sufficient time is allowed for it to reach equilibrium.

During dynamic conditions, the time constant for the operating point to reach equilibrium will be long, but the flow rate of the vapour fraction may be instantaneously increased by increasing the vacuum and by drawing from the vapour store in the evaporator while the flow rate of the liquid fraction delivered to the fuel injection system may be instantaneously decreased in a balanced manner such that a quasi-equilibrium would still exist in which the overall composition of the fuel consumed in the two fractions together remains the same as the original composition of the volatile fuel drawn from the fuel storage tank. As a result, a balance in mass flow can still be maintained even under dynamic conditions.

If desired, the balance may be temporarily disturbed for short periods during certain engine operations, to achieve additional advantages. For example, when starting the engine from cold, an immediate and copious supply of fuel vapour may be extracted from vapour store in the volatising chamber. This would improve the cold start quality and lower the exhaust emissions during warm up of the engine. The vapour may also be pumped into the exhaust system of the engine and burnt upstream of a catalytic convertor to heat the convertor rapidly to its light-off temperature immediately after a cold start.

In another example, it is known in gasoline fuel that the low boiling point hydrocarbons have low octane numbers and the high boiling point hydrocarbons have high octane number, the two fractions together making up the average octane number for the complete fuel blend. There is therefore a knock tolerance advantage if the fuel blend is altered temporarily to bias towards the high boiling point hydrocarbons at least during heavy acceleration modes.

The present invention can be used to achieve this by disproportionately decreasing the vapour fraction and increasing the liquid fraction delivered overall to the engine during heavy acceleration. In this case an increased quantity of the heavy-end of the fuel may be dispensed to the engine while the vapour store in the evaporator will absorb and retain the associated quantity of the light-end of the fuel, such that the total composition of the fuel is fully contained.

If the fuel storage tank is fitted with a vapour storage canister, a purge connection for the vapour canister may be integrated with the fuel vapour extraction system of the present invention. In this case, when the vapour canister is purged, the resulting flow of vapour and air may be arranged to pass through the volatising chamber on its way to the intake system of the engine while maintaining a reduced pressure in the chamber. Some of the purged vapour may condense back into the liquid phase while the air would be fully saturated with vapour.

In the present invention, there is no need at any time to return fuel to the main fuel storage tank. As a result, the risk of building up of temperature and pressure in the fuel tank is minimised. This reduces the loading on the vapour storage canister for evaporative emissions control of the fuel tank and reduces the purge flow necessary to regenerate the canister during the statutory emission test cycle.

In some known prior art systems, fuel vapour is extracted directly from the main fuel storage tank by vacuum and without heating the fuel. The present invention works on a similar principle but has the advantage over such prior art systems that the quality of the fuel in the fuel tank does not deteriorate progressively even though vapour is continuously being produced. Because the unvaporised liquid fuel fraction is always consumed at a balanced rate with the vapour fuel fraction, the composition of the fuel consumed overall will match exactly that present in the fuel storage tank and no surplus liquid will be accumulated.

BRIEF DESCRIPTION OF THE DRAWING

The invention will now be described further, by way of example, with reference to the accompanying drawing, in which the single FIGURE shows a schematic diagram of an engine with a fuel vapour extraction system of the invention.

DETAILED DESCRIPTION OF THE PREFERRED EMBODIMENT

Figure 1:
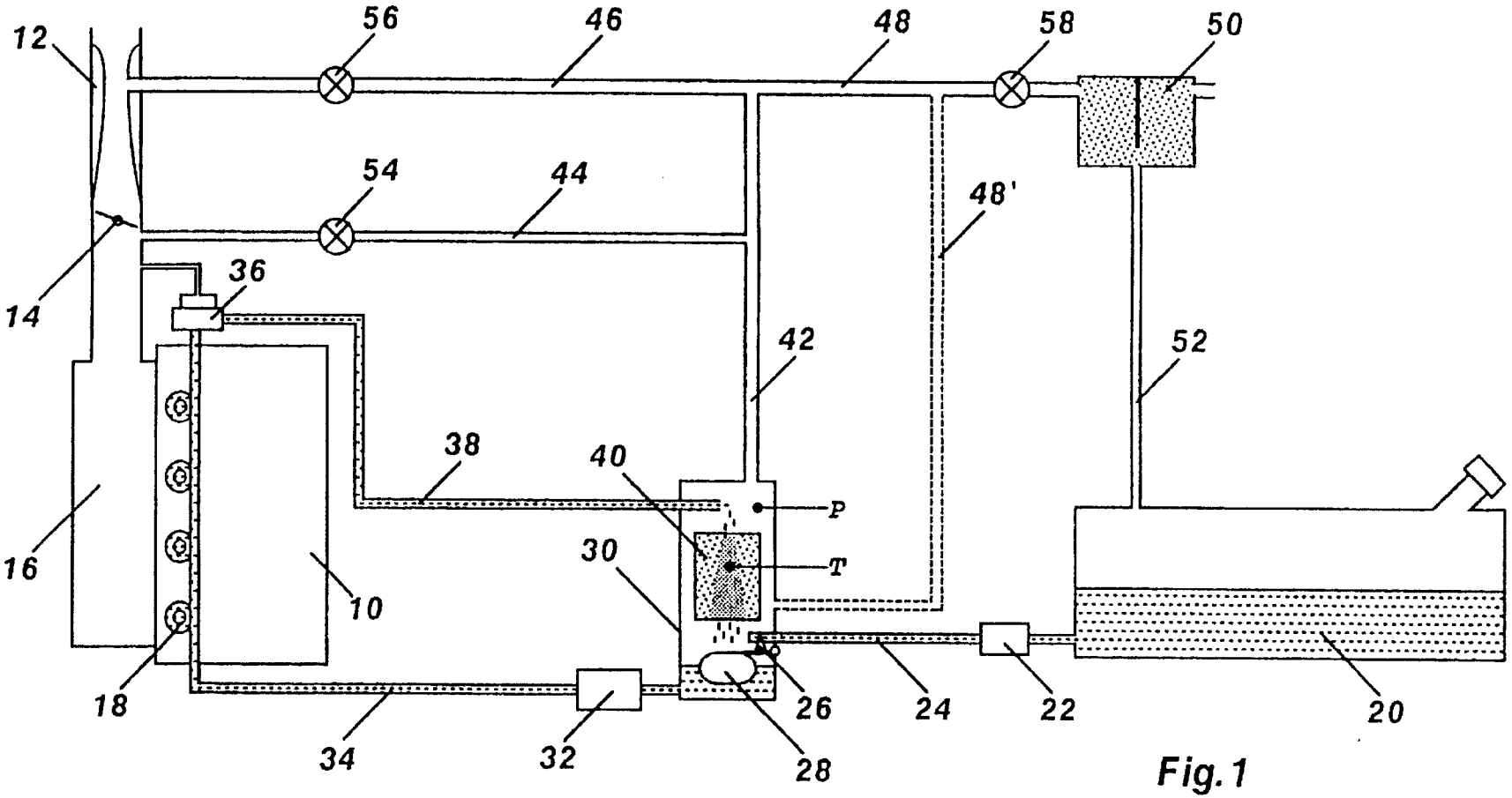

In the drawing, an engine 10 has an intake manifold 16, a main throttle 14 and an intake passage containing a venturi 12. A fuel injection system for the engine comprising a fuel circulation pump 32 that supplies fuel under pressure into a fuel rail 34 from which fuel is dispensed to the individual cylinders of the engine by fuel injectors 18. The pressure in the fuel rail 34 is regulated by a relief valve 36 that derives a reference pressure from the intake manifold 16. Surplus fuel is spilled by the relief valve 36 into a fuel return pipe 38.

While it is conventional for the pump 32 and the return pipe 38 to be directly connected to the main fuel storage tank, designated 20 in the drawing, in the present invention they are connected instead to a volatising chamber 30 that contains a much smaller quantity of fuel. The volatising chamber 30 is connected to the main fuel tank 20 by a supply pipe 24 containing a fuel lifter pump 22 and the level of fuel within the chamber 30 is maintained constant by means of a float 28 and a valve 26.

An evaporator 40 is disposed in the vapour filled space of the chamber 30 above the liquid level and in the path of the fuel returned by way of the fuel return pipe 38. The return fuel is sprayed over the evaporator and the latter is designed to have a large surface area that is coated with a film of fuel. The large surface area may be achieved by using a matrix of capillaries or a porous or sintered block for the evaporator 40. Neither the evaporator 40 nor the fuel in the chamber 30 is heated and evaporation relies on the reduced pressure in the vapour space, the dispersion of the spray droplets, the large surface area of the evaporator 40 and such heat as the return fuel picks up during its circulation flow. The matrix of the evaporator 40 may be formed of a hydrocarbon storage material such as activated carbon to increase the quantity of vapour that can readily be extracted under dynamic conditions.

To maintain the vapour space in the volatising chamber 30 below atmospheric pressure, a pipe 42 leading from it is connected by way of a first pipe 46 and a regulating valve 56 to the venturi 12 and by way of a second pipe 44 and a regulating valve 54 to the intake manifold 16. The pipe 46 is also connected by way of a pipe 48 and a regulating valve 58 to a vapour canister 50 that is itself connected to the ullage space of the main fuel tank 20 by a pipe 52. Instead of the pipe 48 being connected to the pipe 46 to allow fuel vapour stored in the vapour canister 50 to be purged directly into the venturi 12, it is alternatively possible as represented by the pipe 48' shown in dotted lines to route the purge flow to the venturi 12 through the volatising chamber 30.

Under idling and low load conditions, a high vacuum will be present in the intake manifold 16 which will result in a high rate of evaporation of the fuel in the volatising chamber 30 and the bulk of the fuel requirement will be delivered to the engine in vapour form. A small quantity of liquid fuel corresponding to the unvaporised fraction of the fuel will be supplied by the fuel injection system so as to maintain the composition of the fuel consumed overall the same as that present in the fuel storage tank 20.

As the engine load is increased progressively, the pressure in the intake manifold 16 will rise towards atmospheric pressure while the venturi pressure will drop with increasing air flow. By suitable selection of the position of the regulating valves 54 and 56 the vacuum pressure in the volatising chamber 30 can be set to supply vapour at any desired rate while the balance of the fuel to make up the original composition of the fuel is injected by the fuel injectors. During this mode of operation the vacuum alone would not be sufficient to maintain the rate of vapour supply continuously but as a large proportion of the fuel is recirculated in the loop 32, 34, 36, 38 the cooling of the evaporator 40 will be compensated by heat picked up by the recirculating fuel and the evaporation rate will stabilise.

The rate of supply of fuel in vapour form to the engine depends upon the pressure and temperature prevailing in the volatising chamber 30 and the position of the regulating valves 54 and 56. The engine control system will first decide the total quantity of fuel to be burnt and the fractions to be supplied in vapour and liquid forms. Based upon these variables, as can be prior determined by conventional engine fuel calibration maps, the engine management system can set the positions of the regulating valves 54 and 56 to achieve the desired vapour flow rate and the pulse width of the fuel injectors 18 to achieve the desired liquid flow rate.

Under high load conditions, there will be hardly any vacuum in the intake manifold 14 but a high vacuum at the venturi 12. However under such high load it is not desirable to supply fuel vapour as it would reduce the volumetric efficiency and maximum power output of the engine, for which reason the valve 56 can be closed so that all the fuel requirement is met by the injected liquid fuel.

The fact that fuel vapour is used efficiently in running the engine allows proper use of such vapour as is stored in the vapour canister 50. Whereas normally fuel purged from the canister 50 is merely dumped into the intake system in an uncontrolled fashion to regenerate the canister 50, by routing the purge flow through the volatising chamber 30, such vapour flow is taken into consideration in determining the total amount of fuel vapour to be metered to the engine.

As discussed above, the invention copes well with a steady demand for fuel vapour as the operating pressure and temperature will move automatically to match the demand. To cope with sudden changes in the vapour demand, there is a need for a vapour store to act as a buffer. Such a vapour store is already present in the form of the canister 50 the content of which may be used by opening the valve 58 whenever a sudden surge occurs in the demand for fuel vapour. A second vapour store can be formed by using a storage material, such as activated carbon, in the evaporator 40 which will be replenished more rapidly than the vapour canister 50.

As well as supplying fuel vapour to the intake system of the engine as described above, a suction pump in the vapour extraction system can be used to supply vapour under positive pressure into the exhaust system of the engine. This could be desirable, for example to raise the temperature of a catalytic convertor either during cold starts or during long periods of idling.

The described embodiment uses a matrix as a means for promoting evaporation by increasing the surface area to volume ratio of the return fuel but other means can be used to achieve the same objective. For example, the return fuel may be arranged to pass through a spray nozzle and to be atomised into fine droplets during its entry into the volatising chamber 30 in order to increase its surface area to volume ratio significantly and thereby promote its vaporisation.

What is claimed is:

1. A fuel vapour extraction system for an internal combustion engine (10) supplied with a volatile liquid fuel from a fuel storage tank (20), the engine (10) having an air intake system (12,14,16) and a liquid fuel injection system for dispensing fuel to mix with air to be burnt in the engine, the fuel vapour extraction system including a volatising chamber (30) connected to the fuel storage tank (20) by a valve (26) serving to maintain a constant liquid level of fuel in the chamber (30) and a vapour space above the liquid level in the chamber (30), and means (42) for drawing vapour from the vapour space in order to maintain a reduced pressure in the volatising chamber (30), the fuel injection system including a fuel circulation pump (32) for drawing liquid fuel from the volatising chamber (30) and supplying the fuel under pressure to a fuel rail (34), fuel injectors (18) for dispensing metered quantities of fuel from the fuel rail (34) to the engine cylinders, a relief valve (36) for maintaining a constant fuel pressure in the fuel rail (34) and a fuel return pipe (38) for returning unused fuel from the fuel rail (34) to the volatising chamber (30), characterised by means (40) within the vapour space of the volatising chamber for promoting evaporation of the return fuel by significantly increasing the surface area to volume ratio of the return fuel.

2. A fuel vapour extraction system as claimed in claim 1, wherein the means for drawing the fuel vapour and maintaining a reduced pressure in the vapour space of the volatising chamber comprises a connection (46) by way of a regulating valve (56) to a venturi section (12) in an air intake passage of the engine.

3. A fuel vapour extraction system as claimed in claim 1, wherein the means for drawing fuel vapour and maintaining a reduced pressure in the vapour space of the volatising chamber comprises a connection (44) by way of a regulating valve (54) to a low pressure region in the intake system of the engine downstream of the engine main throttle (14).

4. A fuel vapour extraction system as claimed in claim 1, wherein the means for drawing fuel vapour and maintaining a reduced pressure in the vapour space of the volatising chamber comprises a vacuum pump driven directly or indirectly by the engine.

5. A fuel vapour extraction system as claimed in claim 1, wherein the means for promoting evaporation of the return fuel comprises a matrix of fine capillary tubes or porous granules arranged in the path of the return fuel.

6. A fuel vapour extraction system as claimed in claim 1, wherein the matrix comprises a chemically active material to act additionally as a vapour store.

7. A fuel vapour extraction system as claimed in claim 6, wherein the chemically active material includes activated carbon.

8. A fuel vapour extraction system as claimed in claim 7, wherein the means for promoting evaporation of the return fuel comprises means for atomising the return fuel into fine droplets.

9. A fuel vapour extraction system as claimed in claim 2 or claim 3 or any claim appended thereto, having means for measuring the pressure and temperature in the volatising chamber and wherein the engine management system is operative to control the rate of flow of fuel to the engine in vapour and liquid forms in dependence upon the prevailing engine operating conditions and the prevailing pressure and temperature in the volatising chamber.

10. A vapour extraction system as claimed in claim 1, wherein the fuel storage tank (20) is fitted with a vapour storage canister (50) and wherein a connection (48, 48') for purging the vapour canister leads from the canister to the vapour space of the volatising chamber (30).

* * * * *